United States Patent [19]

Ukena et al.

[11] 4,426,266

[45] Jan. 17, 1984

[54] STRIP EDGE OVERCOATING PREVENTING DEVICE FOR CONTINUOUS ELECTROPLATING

[75] Inventors: Toshimichi Ukena; Hiroshi Narumi; Takao Shimizu; Atsushi Nagashima, all of Chiba, Japan

[73] Assignee: Kawasaki Steel Corporation, Kobe, Japan

[21] Appl. No.: 493,418

[22] Filed: May 10, 1983

[30] Foreign Application Priority Data

Feb. 28, 1983 [JP] Japan ..... 58-32502

[51] Int. Cl.[3] ..... C25D 17/00

[52] U.S. Cl. ..... 204/206; 204/DIG. 7

[58] Field of Search ..... 204/206, 211, DIG. 7

[56] References Cited

U.S. PATENT DOCUMENTS 2,461,556 2/1949 Torig ..... 204/DIG. 7
3,567,595 3/1971 Yates ..... 204/DIG. 7
4,072,581 2/1978 Allen ..... 204/206

FOREIGN PATENT DOCUMENTS 54-128945 10/1979 Japan ..... 204/DIG. 7
54-130444 10/1979 Japan ..... 204/206

*Primary Examiner*—T. M. Tufariello
*Attorney, Agent, or Firm*—Balogh, Osann, Kramer, Dvorak, Genova & Traub

[57] ABSTRACT

A device according to the invention comprises trolleys arranged above a plating bath and movable in transverse directions of a steel strip, guide rollers secured to lower ends of vertical levers depending from the trolleys and in contact with edges of the strip by urging means such as counter weights acting upon the vertical levers, and shielding plates secured to the lower ends of the vertical levers below the guide rollers so as to shield undersides of the strip in the proximity of the edges from anodes immersed in the plating bath in opposition to the strip.

The device according to the invention can maintain the positional relation between the edges of the strip and shielding plates notwithstanding staggering movements of the strip to prevent the edges of the strip from being excessively plated.

11 Claims, 10 Drawing Figures

STRIP EDGE OVERCOATING PREVENTING DEVICE FOR CONTINUOUS ELECTROPLATING

BACKGROUND OF THE INVENTION

1. Field of the Invention

This invention relates to a device for improving distribution of metal deposit on a strip in its transverse direction in a continuous electroplating apparatus, and more particularly a device for preventing edges of a steel strip from being locally excessively plated in continuously feeding the strip in an electroplating apparatus.

2. Description of the Prior Art

The word "strip" used herein means steel strips and other metal strips which are relatively thin and remarkably long so as to be rolled in a coil.

The term "overcoating" used herein means locally excessive metal depositing of a plating metal on a surface to be plated.

In continuous electroplating, a traveling strip serves generally as a cathode in opposition to anodes immersed in a plating bath at its bottom to effect electrolytic action or plating during the movement of the strip. There is a general tendency of plating current to concentrate at the proximities of edges of the strip so as to cause locally excessive deposit of a plating metal thereat i.e. "edge overcoating".

In order to avoid such an edge overcoating, shielding plates made of electric insulating materials have been arranged in plating baths to partially conceal undersides of edges of strips in their longitudinal directions from the anodes. The shielding plates are positionally controlled so as to be brought into their optimum positions with the aid of signals from detectors located on one sides of the strips at entrances of the baths for detecting variation in width of the strips.

With such a control system, however, it is usually difficult to control the shielding plates with required high accuracy because of undesirable disturbance due to splashing and vaporization of the plating liquid or the like. Particularly, the shielding plates do not necessarily follow frequent movements of the edges of the strips resulting from their staggering movements and the like unavoidable in traveling, so that the shielding plates do not exhibit the expected effect preventing the edge overcoating and what is worse still they often cause another trouble "edge undercoating" which means locally insufficient metal deposit.

SUMMARY OF THE INVENTION

It is an object of the invention to provide a device for preventing the edge overcoating of a strip, which is not adversely affected by staggering movements of the strip.

It is a further object of the invention to provide a device for preventing the edge overcoating, which comprises guide rollers for maintaining positional relation between edges of a strip and shielding plates notwithstanding staggering movements of the strip.

In order to achieve these objects, a device for preventing edges of a strip from being excessively plated in a continuous electroplating apparatus whose anodes are arranged in opposition to said continuously moving strip and immersed in a plating bath at its bottom, according to the invention said device comprises trolleys arranged above said plating bath and movable in transverse directions of said strip, guide rollers rotatably secured to lower ends of levers depending from said trolleys, respectively, and rotated by and in contact with said edges of the strip by urging means, and shielding plates secured to said lower ends of said levers below said guide rollers so as to lengthwise shield undersides of said edges of the strip from said anodes.

In a preferred embodiment of the invention, the trolleys arranged side by side in the transverse direction of the strip comprise trolley positioning means for positioning said trolleys into optimum positions in response to a variation in width of said strip with the aid of a signal generated from a strip width variation detector for detecting the variation in width of said strip.

In order that the invention may be more clearly understood, preferred embodiments will be described, by way of example, with reference to the accompanying drawings.

DETAILED DESCRIPTION OF THE PREFERRED EMBODIMENT

Figure 1:
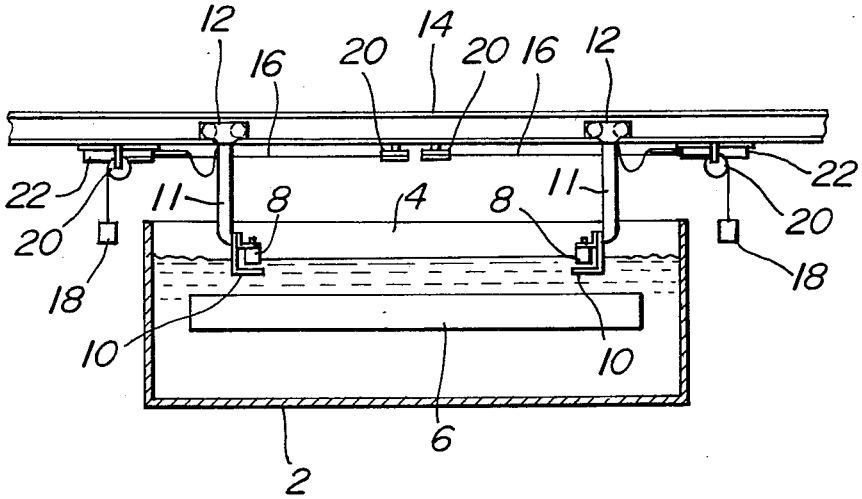
FIG. 1 is a cross-sectional view of a continuous electroplating system provided with the device according to the invention.
Figure 2:
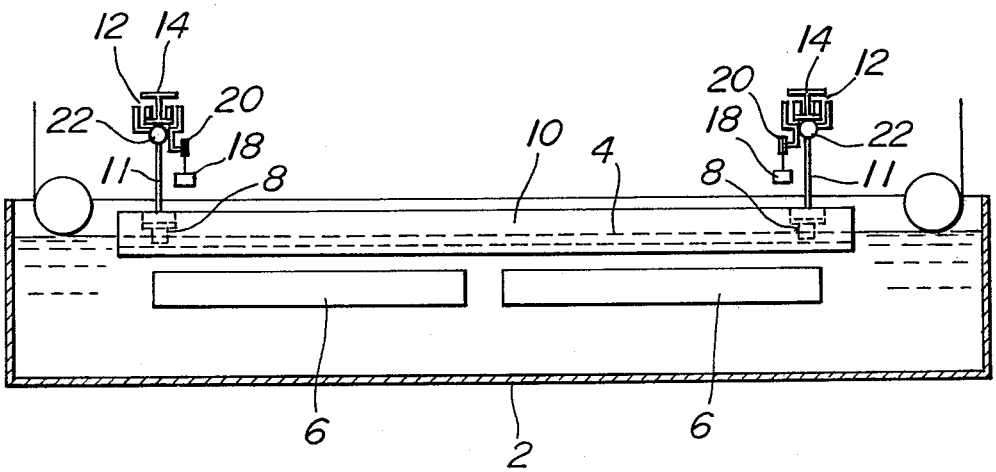
FIG. 2 is a longitudinal-sectional view of the system shown in FIG. 1.

FIGS. 1 and 2 illustrate a steel strip continuous plating system having the above mentioned constitution in cross-section and longitudinal-section. A plating tank 2 including a plating bath accommodates therein anodes 6 in opposition to a steel strip 4 to be plated.

The steel strip 4 is continuously fed through the plating tank 2 to form a cathode with conventional conductor rolls (not shown). The anodes 6 are arranged immersed in the plating bath at the bottom of the plating tank 2 below the steel strip 4.

Guide rollers 8 of an electric insulating material are arranged to be driven and rotated by side surfaces of edges of the steel strip 4 in contact therewith so as to form parts of shielding plates 10 also made of an electric insulating material. The shielding plates 10 are arranged below the edges of the steel strip 4 so as to shield the edges from the anodes 6 and supported by substantially vertical levers 11 hanging from trolleys 12 with wheels traveling on I-beams 14 extending in a transverse direction of the steel strip 4 such that the levers 11 are movable together with the trolleys 12 in the transverse direction of the steel strip 4.

In this embodiment, the trolleys 12 are forced toward each other by weights 18 connected to ropes 16 extending about pulleys 20 so that the shielding plates 10 at the bottoms of the vertical levers 11 are forced into contact with the side surfaces of the edges of the steel strip 4. On the other hand, the vertical levers 11 and hence the shielding plates 10 are forced away from the side surfaces of the edges of the steel strip 4 by pneumatic cylinders 22 whose piston rods are connected to the vertical lever 11 by means of ropes shown in a slack condition in FIG. 1.

Figure 3:
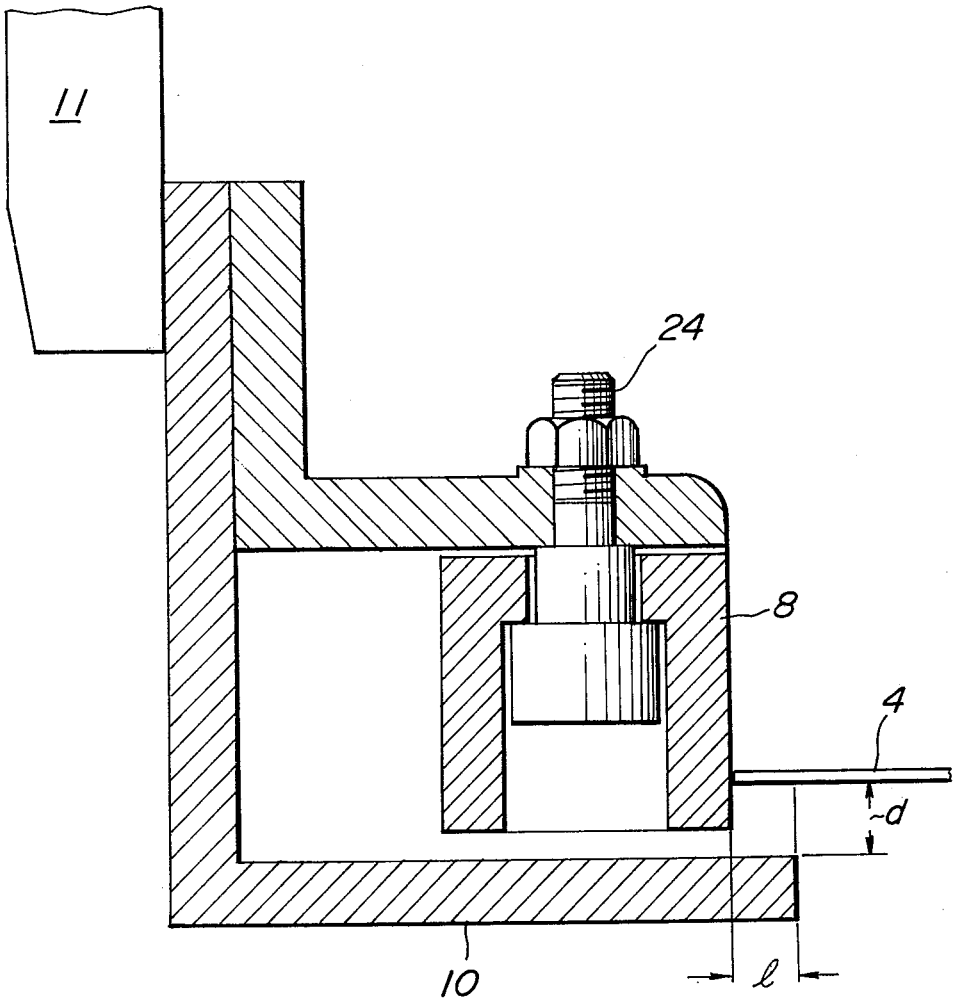
FIG. 3 is a sectional view of a guide roller and a shielding plate used in the device according to the invention.

Referring to FIG. 3 illustrating mounting of the guide roller 8 in detail, a stepped shaft 24 rotatably supports the guide roller 8 adapted to be in contact with the edge of the steel strip 4 so as to obtain a positional relation of the edge of the steel strip 4 with the shielding plate for preventing the edge overcoating determined by an overlapping length l and a vertical distance d between the shielding plate 10 and the edge of the steel strip 4 determined by a hanging position of the vertical lever 11.

In this manner, during the passing of the steel strip 4 through the plating bath, the edges of the steel strip 4 are shielded by the shielding plates 10 from the anodes 6, and the guide rollers 8 are always kept in contact with the edges of the steel strip 4 by the action of the weights 18 so that even if the steel strip 4 happens to be staggered or irregularly moved in its transverse direction the above positional relation can be maintained at constant by horizontal movements of the vertical lever 11 correspondingly caused by the irregular movements of the steel strip 4. In order to obtain a good result, l and d are preferably less than 5 mm and 10–20 mm, respectively. If l is more than 5 mm and d is less than 10 mm, the plating at the edges of the steel strip may become insufficient. When d is more than 20 mm on the other hand, the shielding effect of the plates 10 cannot be expected.

In order to clarify the effect of the edge overcoating preventing device, steel strips were plated to aim at 3.0 $g/m^2$ of tin deposit all over their one sides with a continuous electric tin-plating system according to the halogen method under a constant plating condition of electric current density, feeding speed of the strips, concentration of plating bath and the like. The distances $l=5$ mm and $d=15$ mm were set for the edge overcoating preventing device as shown in FIG. 3. Examples of results of the experiment are shown in comparison of the invention using the edge overcoating preventing device with the prior art without such device are shown in FIGS. 4*a* and 4*b* which illustrate distribution of tin deposit on the one sides to be plated and on the other not plated sides, respectively.

Figure 4A:
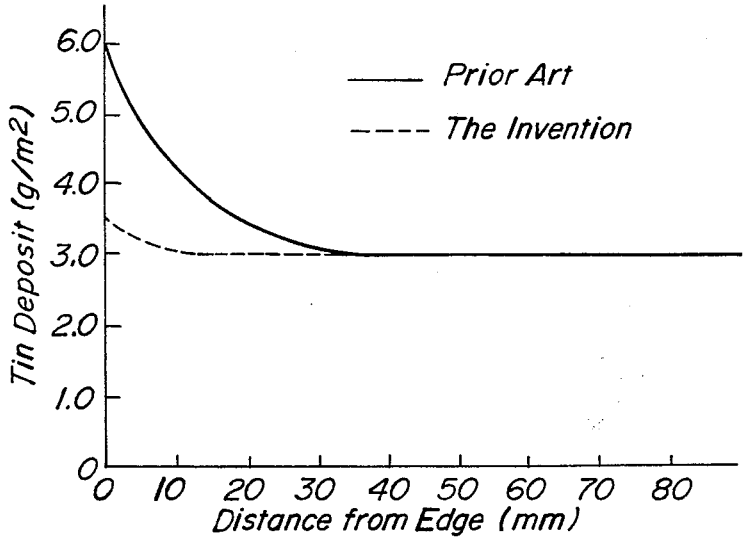
FIG. 4*a* is a graph illustrating distributions of plating metal deposit on surfaces to be plated in comparison of the invention and the prior art.
Figure 4B:
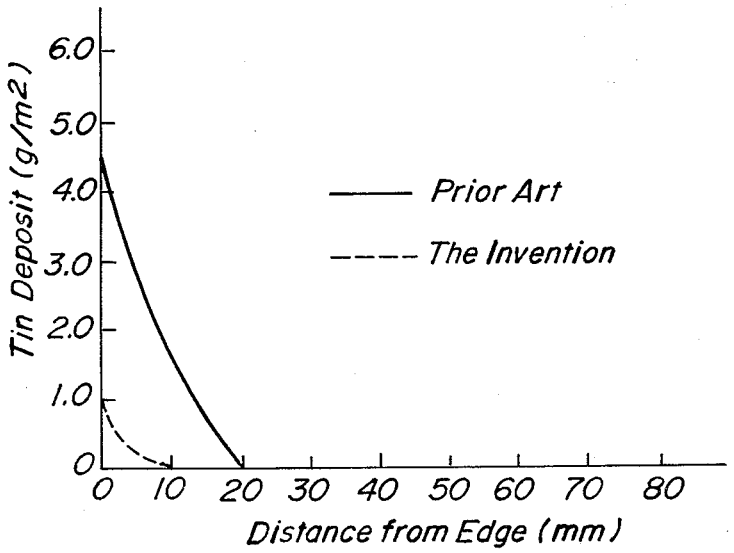
FIG. 4*b* is a graph illustrating metal deposits of plating metal on surfaces not to be plated in comparison of the invention and the prior art.

As can be seen from FIGS. 4*a* and 4*b*, it should be noticed that the edge overcoating preventing device according to the invention can of course prevent the excess deposit or coating at the edges of the surfaces of the steel strips to be plated and at the same time can prevent the edges of the other or upper surfaces of the strips from being plated, which would otherwise be undesirably plated due to the fact that part of the plating bath covers the edges of the upper surfaces of the steel strips.

Figure 5:
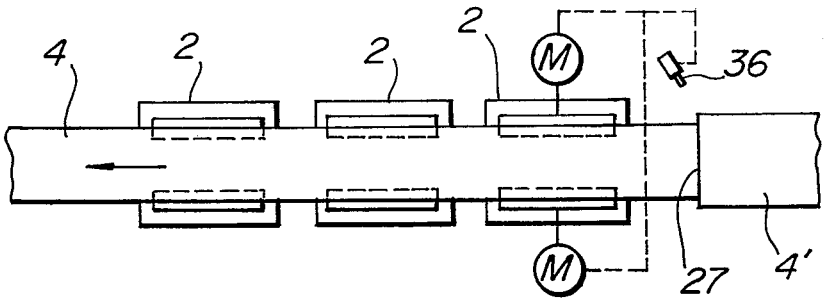
FIG. 5 is a plan view showing another continuous electroplating system to be applied with the invention.
Figure 6:
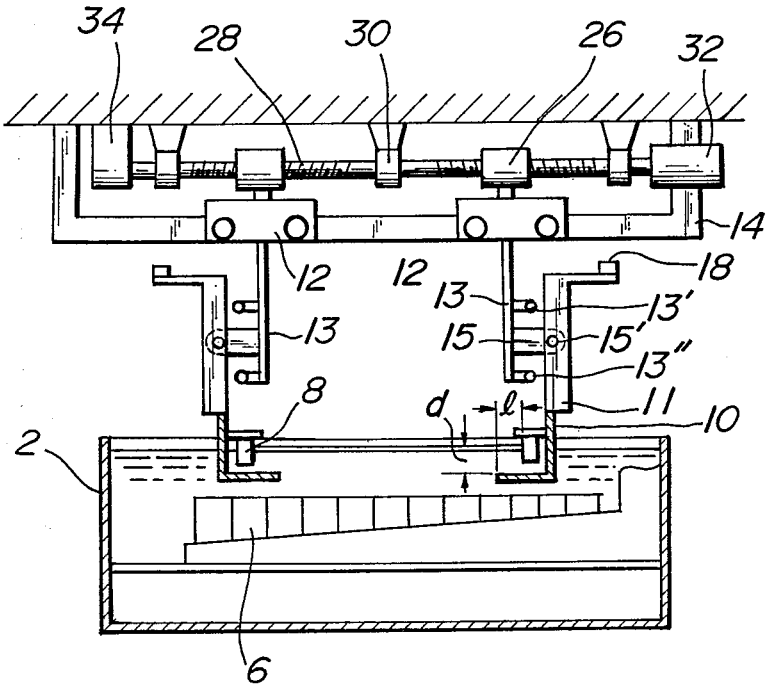
FIG. 6 is a cross-sectional view of the system shown in FIG. 5.
Figure 7:
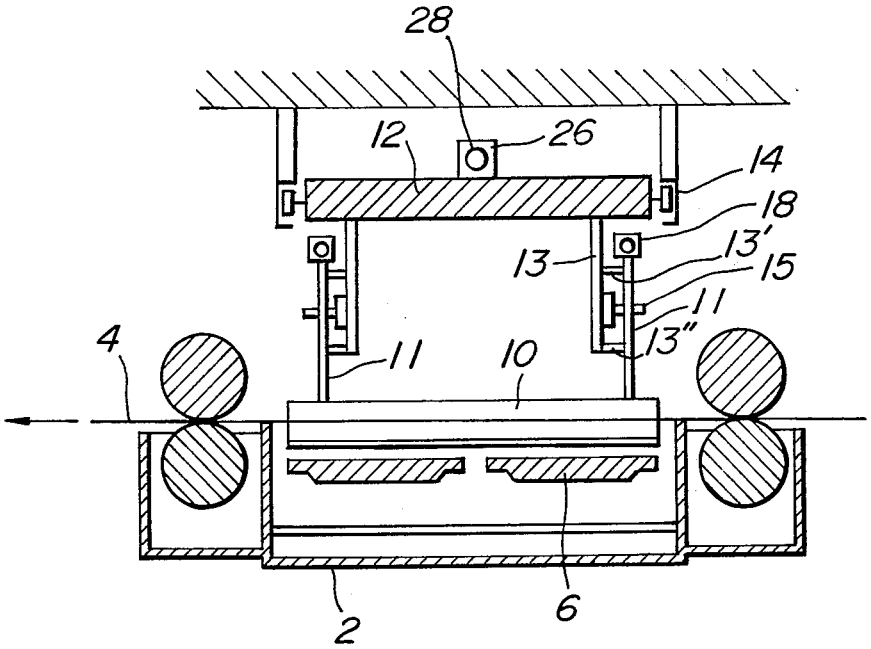
FIG. 7 is a longitudinal-sectional view of the system shown in FIG. 5.

FIG. 5 illustrates in a plan view a series of plating tanks arranged in tandem of a continuous electric tin-plating system according to the halogen method. FIGS. 6 and 7 illustrate a cross-section and a longitudinal-section of one of the plating tanks, respectively.

With this embodiment, the plating bath is controlled so as to permit its surface to be coincident with the lower surface of the steel strip 4 and anodes 6 such as tin blocks are immersed in the plating bath at the bottom of the tank in the same manner as in the above embodiment. Conventional conductor rolls are used for supplying electric current to the steel strips 4 which continuously passed through the plating bath as a cathode to be tin-plated.

As shown in FIG. 6, trolleys 12 with wheels are movable above the plating tank 2 in transverse directions of the steel strip 4 along rails on a frame structure 14. In this embodiment, as shown in FIG. 7 each trolley 12 fixedly supports at its ends arms 13 depending therefrom. The arms 13 are provided with laterial shafts 15 having pivotal pins 15' pivotally supporting rocking levers 11 substantially at their mid portions. As is clear in comparison of FIG. 6 with FIG. 7, the four rocking levers 11 are provided per one plating tank 2. To lower ends of the rocking levers 11 are secured shielding plates 10 along the longitudinal direction of the strip 4 or length of the trolleys. The shielding plate 10 is partially immersed in the plating bath so as to shield lower edge surfaces of the steel strip 4 from the anodes 6. To the lower end of the each rocking lever 11 is rotatably mounted a guide roller 8 adapted to be in contact with the edge of the steel strip 4 as shown in FIG. 3. A counter weight 18 is detachably mounted on an end of an outwardly extending member on an upper end of the each rocking lever 11 for adjusting the contact force of the guide roller 8 with the edge of the steel strip 4 by exchanging the weight 18. In this manner, the rocking levers 11 are rockable in the transverse directions correspondingly to the staggering or irregular movement of the steel strip 4. Stoppers 13' and 13'' are provided on the arms 13 to control the rocking angles of the rocking levers 11 as shown in FIGS. 6 and 7.

The trolleys 12 are in symmetry arranged one on each side of the feeding line of the steel strip 4. In this embodiment, nuts 26 fixed to the trolleys 12 are threadedly engaged with a screw-shaft 28 which is supported by bearings 30 and provided on its respective ends with a motor 32 for driving the screw-shaft 28 and a revolution number detector 34 for the screw-shaft 28. The screw-shaft 28 is formed on both sides of its mid portion with right and left hand screw threads so that the screw-shaft 28 is rotated by the driving motor 32 to move the trolleys toward or away from each other. The traveling distances of the trolleys are detected by the product of the detected value in the revolution number detector 34 and the pitch of the screw threads of the screw-shaft 28. In this manner, trolley positioning means is provided. The above arrangement for positioning the trolleys 12 in the transverse directions of the steel strip 4 is only one example. Any positioning means other than the above arrangement may be used for this purpose, so long as the positioning means is able to drive and stop the trolleys depending upon the width of the steel strip.

As above mentioned, the rocking levers 11 hanging from the trolley 12 through the arms 13, lateral shafts 15 and pivotal pins 15' shown in FIG. 6 are rockable in the transverse directions of the steel strip 4 with the guide rollers 8 in contact with the edges of the steel strip 4. Accordingly, the positional relation between the steel strip 4 and the shielding plates 10 are kept constant notwithstanding the staggering or irregular movement of the steel strip 4.

The contact force between the guide rollers 8 and edges of the steel strip 4 is exactly adjustable within fine ranges by adjusting weights of the counter weights 18. Such contact force adjusting means for the guide roller 8 is only one example and any other adjusting means different in configuration and construction may be used for this purpose so long as it is able to adjust the roller finely and exactly.

The contact force between the guide rollers 8 and the steel strip is dependent upon the thickness of the steel strip 4 and is preferably smaller, usually 0.1–0.6 kg at one roller 8, so as not to damage the edges of the steel strip 4.

The guide roller 8 is preferably made of a wear-resistant hard material in consideration of the thin strip material 4 in contact therewith and is preferably made of a high insulating material in order to prevent the roller itself from being plated. In view of these points, a ceramic material or the like is suitable for the roller.

Figure 8:
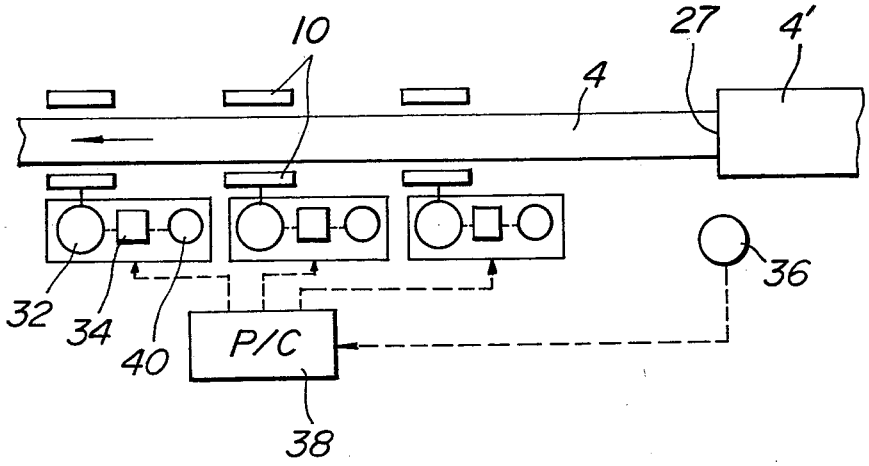
FIG. 8 illustrates a control system for guide rollers to accommodate variation in width of strips.

In general, there are many strips 4 having various thicknesses. FIG. 8 illustrates a narrower steel strip 4 followed by a wider steel strip 4'. Frequently, the strips 4 and 4' are integrally welded at 27 to form a unitary steel strip, thereby enabling them to be continuously plated.

Figure 9:
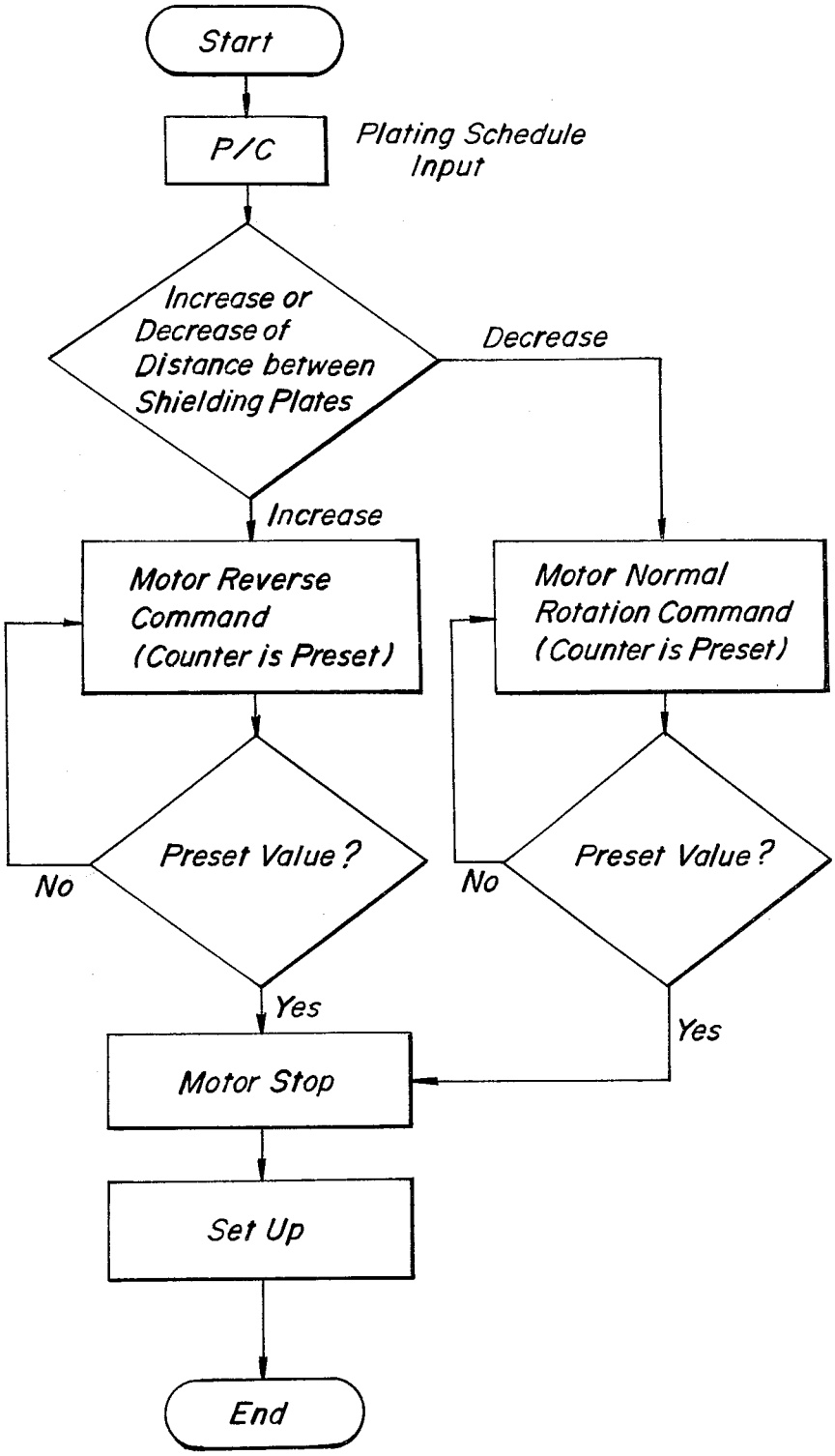
FIG. 9 shows one example of a flow chart for the control system shown in FIG. 8.

A reference numeral 36 in FIG. 8 denotes a detector for detecting the widths of the steel strips 4 and 4', which detects variation in width at the welded portion. In fact, the detector 36 detects the weld line between the steel strips 4 and 4'. Any existing sensor may be used as the detector 36. Upon detecting the variation in width of a steel strip, the detector 36 generates a signal which is fed to a controller or process computor 38 in FIG. 8 which in turn generates a signal for commanding the motor 32 to rotate in a normal or reverse direction according to preset values of plating schedules, for example, widths of steel strips, feeding speeds of the steel strips, distances from the detecting position to the shielding plates and the like to move and stop in timing the trolleys 12 at locations to meet the width of the steel strip. The detector 36, controller 38, timers 40, revolution number detectors 34 and motors 32 form position control means. The timer 40 serves to delay the operation of the motor 32 corresponding to the distance between the motor 32 and the detector 36. FIG. 9 illustrates a typical flow chart for the controlling means.

As above described, the trolleys 12 are moved and stopped at locations where the guide rollers 8 are ideally in contact with the edges of the steel strip 4. This operation can be automatically controlled. During the movement of the steel strip through the plating tank, it is unavoidably staggered in the order of the maximum ±30 mm in the transverse direction of the steel strip 4. Upon the staggering movement of the steel strip, the rocking levers 11 are rocked about the pivotal pins 15' to keep the guide rollers 8 in slight contact with the edges of the strip 4, thereby always enabling the guide rollers 8 to follow the staggering movement of the steel strip 4.

In this manner, the positional relation between the edges of the steel strip 4 and the shielding plates 10 is always kept constant to prevent the edges of the steel strip from being excessively plated. It is not necessary to move the trolleys 12 until the plating of the same size steel strips is completed. The steel strips are connected at their trailing and leading ends one coil to the other by welding. If there is a difference in width of the strips, the detector 36 detects the width difference to move the trolleys 12 in timing to suitable positions depending upon the width of the relevant steel strip so as to accommodate the variation in width of the strip without any trouble.

As can be seen from the above description, even if a steel strip is unavoidably staggered or irregularly moved in its transverse direction during its movement through a plating tank, the device for preventing edge overcoating in plating according to the invention is capable of maintaining in the optimum condition the positional relation between the edges of the steel strips and shielding plates for preventing the edge overcoating by following movements of the shielding plates, thereby ensuring the prevention of the edge overcoating.

It is further understood by those skilled in the art that the foregoing description is that of preferred embodiments of the disclosed devices and that various changes and modifications may be made in the invention without departing from the spirit and scope thereof.

What is claimed is:

1. A device for preventing edges of a strip from being excessively plated in a continuous electroplating apparatus whose anodes are arranged in opposition to said continuously moving strip and immersed in a plating bath at its bottom, said device comprising trolleys arranged above said plating bath and movable in transverse directions of said strip, guide rollers rotatably secured to lower ends of levers depending from said trolleys, respectively, and rotated by and in contact with said edges of the strip by urging means, and shielding plates secured to said lower ends of said levers below said guide rollers so as to shield undersides of said edges of the strip from said anodes.

2. A device as set forth in claim 1, wherein each said urging means comprises a weight connected to a rope extending about fixed pulleys and having one end connected to said trolley or said lever so as to force said lever toward the other lever in opposition thereto and hence to force said guide roller into contact with said edge of the strip.

3. A device as set forth in claim 2, wherein there is provided a pneumatic cylinder for each the trolley, whose piston rod is connected to said trolley or said lever by means of a rope, thereby forcing said guide roller away from said edge of the strip.

4. A device as set forth in claim 1, wherein said trolleys arranged side by side in the transverse direction of the strip comprise trolley positioning means for positioning said trolleys into optimum positions in response to a variation in width of said strip with the aid of a signal generated from a strip width variation detector for detecting the variation in width of said strip.

5. A device as set forth in claim 4, wherein said trolley positioning means comprises a driving motor, a screw-shaft driven by said driving motor and formed on both sides of its mid portion with right and left hand screw treads, nuts threadedly engaged with said right and left hand screw threads of the screw-shaft and secured to said trolleys, respectively, and a revolution number detector for detecting revolution numbers of said screw-shaft.

6. A device as set forth in claim 5, wherein arms are fixedly secured to each said trolley and depending therefrom and each the arm is provided with a lateral shaft which pivotally supports said lever having at its lower portion said guide roller and common said shielding plate.

7. A device as set forth in claim 6, wherein said lever is provided with said urging means comprising a counter weight for forcing said guide roller against said edge of the strip.

8. A device as set forth in claim 7, wherein said counter weight is detachably mounted on an outwardly extending member of said lever.

9. A device as set forth in claim 6, wherein said arm is provided with stoppers for controlling rocking angles of said lever.

10. A device as set forth in claim 5, wherein said trolley positioning means further comprises a controller for receiving the signal from said strip width variation detector and feeding a signal to said motor for said screw-shaft to drive it according to preset values of plating schedule and a timer for accommodating a distance between said motor and said strip width variation detector to form position control means with said strip width variation detector, and said revolution number detector and said motor.

11. A device as set forth in claim 10, wherein there are provided a plurality of said devices corresponding to a plurality of plating baths and are provided a plurality of said position control means for the respective devices commonly using said strip width variation detector and said controller.

* * * * *